US007601389B2

(12) United States Patent
Kuwabara et al.

(10) Patent No.: US 7,601,389 B2
(45) Date of Patent: Oct. 13, 2009

(54) METAL MATERIAL AND METHOD FOR PRODUCTION THEREOF

(75) Inventors: Mitsuo Kuwabara, Tsurugashima (JP); Tadashi Okada, Saitama (JP); Naoji Yamamoto, Shizuoka-ken (JP); Masahito Hasuike, Hamamatsu (JP); Hideo Yoshikawa, Shizuoka-ken (JP); Michiharu Hasegawa, Mie-ken (JP); Tetsuaki Aoki, Kumamoto-ken (JP); Masanori Kogawa, Kumamoto-ken (JP); Kazunori Sakamoto, Kumamoto-ken (JP); Keizou Tanoue, Kumamoto (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 637 days.

(21) Appl. No.: 10/523,266

(22) PCT Filed: Jul. 31, 2003

(86) PCT No.: PCT/JP03/09737

§ 371 (c)(1),
(2), (4) Date: Nov. 9, 2005

(87) PCT Pub. No.: WO2004/013370

PCT Pub. Date: Feb. 12, 2004

(65) Prior Publication Data

US 2006/0134453 A1 Jun. 22, 2006

(30) Foreign Application Priority Data

| | | |
|---|---|---|
| Aug. 1, 2002 | (JP) | 2002-225216 |
| Aug. 1, 2002 | (JP) | 2002-225220 |
| Aug. 1, 2002 | (JP) | 2002-225228 |
| Aug. 1, 2002 | (JP) | 2002-225231 |
| Aug. 1, 2002 | (JP) | 2002-225236 |

(51) Int. Cl.
*B05D 1/12* (2006.01)

(52) U.S. Cl. ..... 427/191; 427/201

(58) Field of Classification Search ..... None
See application file for complete search history.

(56) References Cited

U.S. PATENT DOCUMENTS

| | | | | |
|---|---|---|---|---|
| 5,549,927 | A * | 8/1996 | Cottone et al. | 427/191 |
| 6,270,914 | B1 | 8/2001 | Ogasawara et al. | |

FOREIGN PATENT DOCUMENTS

| | | |
|---|---|---|
| JP | 52-115749 | 9/1977 |

(Continued)

OTHER PUBLICATIONS

Takeshi Naito, Practical Operation Of Carburizing arid Quenching, First Edition, Aug. 30, 1979 p. 37.

*Primary Examiner*—Frederick J Parker
(74) *Attorney, Agent, or Firm*—Carrier, Blackman & Associates, P.C.; Joseph P. Carrier; William D. Blackman

(57) ABSTRACT

A metal material comprises a Zn—Al—Sn based alloy (ZAS alloy) and Cu diffused in the alloy, wherein Cu is diffused into the inside of the alloy to a depth from the surface of 0.5 mm or more, the concentration of Cu decreases from the surface of the ZAS alloy towards the inside thereof, and there is present no specific interface between Cu and the ZAS alloy; and a method for producing the metal material involves applying, to the surface of the ZAS alloy, an agent comprising a solvent and, dispersed therein, a material containing Cu such as a Cu powder and a Cu—Mn alloy powder and preferably, dispersed or dissolved therein, a reducing agent capable of reducing an oxide film present on the surface of the ZAS alloy, and heating the ZAS alloy having the agent applied thereon, to thereby diffuse Cu into the alloy.

8 Claims, 15 Drawing Sheets

FOREIGN PATENT DOCUMENTS

| | | |
|---|---|---|
| JP | 54-032131 | 3/1979 |
| JP | 58-174566 | 10/1983 |
| JP | 62-253781 | 11/1987 |
| JP | 02-181005 | 7/1990 |
| JP | 03-024245 | 2/1991 |
| JP | 03-287776 | 12/1991 |
| JP | 04-258356 | 9/1992 |
| JP | 05-007987 | 1/1993 |
| JP | 05-009632 | 1/1993 |
| JP | 05-065567 | 3/1993 |
| JP | 08-013128 | 1/1996 |
| JP | 08-117966 | 5/1996 |
| JP | 08-325703 | 12/1996 |
| JP | 09-272932 | 10/1997 |
| JP | 2832224 B | 10/1998 |
| JP | 2000-043057 | 2/2000 |
| JP | 2001-025856 | 1/2001 |
| JP | 2001-049462 | 2/2001 |

* cited by examiner

FIG. 13

| | SEEDING TIMING (SECOND) | | | | |
|---|---|---|---|---|---|
| | 1 | 5 | 10 | 30 | 60 |
| THICKNESS OF MICROSTRUCTURAL CHANGE (mm) | 1～3 | 2～3 | 5～7 | 4～10 | 10～20 |
| CRYSTAL GRAIN SIZE (μm) | 40～100 | 30～50 | 10～30 | 20～40 | 60～80 |
| HARDNESS (HV) | 120～135 | 150～180 | 230～240 | 220～240 | 140～160 |

METAL MATERIAL AND METHOD FOR PRODUCTION THEREOF

TECHNICAL FIELD

The present invention relates to a metal material, especially a zinc alloy which is excellent in strength, hardness, and heat resistance, and a method of producing the same.

BACKGROUND ART

A variety of surface treatments are applied to metal materials in order to improve various characteristics such as abrasion resistance, corrosion resistance, and strength. Surface treatments include carburization, sulfurizing, nitriding, and carbonitriding. In other cases, a coating may be provided by means of, for example, the physical vapor deposition (PVD) method, the chemical vapor deposition (CVD) method, the plating, and the anodic oxidation.

For example, the means for hardening the surface of a Zn alloy such as Zn—Al—Sn alloys is exemplified by a direct electroless nickel plating method disclosed in Japanese Patent No. 2832224. In this method, a die composed of the Zn alloy is immersed in an electroless nickel plating solution containing an organic acid nickel salt or the like to form a nickel coating on the surface of the die.

According to Japanese Patent No. 2832224, the Zn alloy coated with nickel coating as described above is satisfactory in abrasion resistance and corrosion resistance.

However, in any one of the methods as described above, the improvement in various characteristics is limited to the surface of the metal material. For example, in the case of the nitriding and the carburization, the element is diffused only by several tens μm, or about 200 μm at the maximum from the surface of the metal material. It is difficult to improve various characteristics in other regions disposed more internally than the foregoing.

This inconvenience similarly occurs in the coating formation as represented by the invention disclosed in Japanese Patent No. 2832224 described above. Further, in this case, the interface exists between the coating and the metal material. Therefore, when the coefficient of thermal expansion of the coating is extremely different from that of the metal material, the film may be exfoliated by repeating the heating and the cooling.

Further, in certain metal materials such as Zn alloys, Al alloys, and Ti alloys which have an oxide film formed quickly on the surface, the method of forming the coating may be limited to the plating, the anodic oxidation, or the like. By such methods, the thickness of the coating is small. Therefore, various characteristics cannot be sufficiently improved.

DISCLOSURE OF THE INVENTION

A principal object of the present invention is to provide a metal material which has sufficient strength, hardness, and heat resistance from the surface to the inside of the metal material, and a method of producing the same.

According to one aspect of the present invention, there is provided a metal material comprising a diffusion layer containing an element diffused in a base material of a metal, wherein the element is diffused from a surface to inside of the base material to a depth of not less than 0.5 mm; and a concentration of the element is gradually decreased from the surface to the inside of the base material.

In the present invention, the distance of diffusion of the element is remarkably large as compared with a case in which the treatment such as the carburization and the nitriding is applied. Accordingly, various characteristics such as the heat resistance, the strength, the hardness, and the corrosion resistance are improved to the deep inside.

The metal material, which serves as the base material, is not specifically limited. However, preferred examples may include Zn, Zn alloy, Al, Al alloy, Mg, Mg alloy, Cu, Cu alloy, Ti, Ti alloy, Fe, and Fe alloy.

The Zn alloy is provided with the heat resistance, the strength, and the hardness in a variety of forms. In a preferred aspect, an alloy layer, which is harder than the base layer, is formed at the surface layer. The alloy layer includes an Fe alloy layer which is formed on the surface, and a diffusion layer which is formed between the Fe alloy layer and the base layer. A part of copper or manganese, which is contained in the diffusion layer, is diffused to the base layer.

In another preferred aspect, the alloy layer formed at the surface layer includes a brass diffusion layer containing at least one of iron, nickel, chromium, molybdenum, cobalt, and ceramics.

According to another aspect of the present invention, there is provided a method of producing a metal material comprising a diffusion layer which is formed by diffusing an element into a base material of a metal and which has a depth from a surface of said base material of not less than 0.5 mm, a concentration of the element being gradually decreased from the surface to the inside of the base material, the method comprising:

coating said surface of said base material with a coating agent, the coating agent including a powder of a substance containing the element to be diffused, and the powder of the material being dispersed or dissolved in a solvent; and diffusing the element into the base material by heating the base material which is coated with the coating agent. The metal material can be obtained easily and conveniently by heating after applying the powder with the solvent.

When the base material is a metal material which readily forms an oxide film of, for example, Zn alloy or Al alloy, it is preferable that a reducing agent for reducing the oxide film is applied together with the substance, for the following reason. The oxide film is reduced to disappear under the action of the reducing agent. Therefore, the element can be diffused onto the base material without supplying an extremely large amount of thermal energy.

In still another aspect concerning the Zn alloy, a powder of a hydrocarbon compound and at least one metal powder of magnesium, aluminum, or manganese, or at least one alloy powder of magnesium alloy, aluminum alloy, or manganese alloy are dispersed in an organic solvent to obtain a powdery dispersing agent. When the surface of the Zn alloy is coated with the powdery dispersing agent, and the Zn alloy is heat-treated thereafter, then the oxide film is removed from the Zn alloy.

In still another aspect concerning the Zn alloy, the base material (Zn alloy) is processed to have a predetermined shape, and then a first powder containing at least one of copper and manganese and a second powder of Fe alloy are successively applied to at least a part of the base material. Subsequently, the portion, to which the first powder and the second powder have been applied, is heated in an inert atmosphere. Accordingly, it is possible to reliably obtain the Zn alloy which has a high strength surface layer and which is excellent in heat resistance. The Zn alloy can be used for a variety of parts such as dies favorably.

Alternatively, after processing the base material (Zn alloy) to have a predetermined shape, at least a part of the base material may be coated with a powder containing an essential component of copper or manganese and containing at least one of iron, nickel, chromium, molybdenum, cobalt, and ceramics. Subsequently, the portion which is coated with the powder may be heated in an inert atmosphere.

In still another aspect concerning the Zn alloy, at least one of copper and manganese is added as a seeding agent to a molten metal when casting is performed by using the molten metal of Zn or Zn alloy.

The above and other objects, features, and advantages of the present invention will become more apparent from the following description when taken in conjunction with the accompanying drawings in which a preferred embodiment of the present invention is shown by way of illustrative example.

BRIEF DESCRIPTION OF THE DRAWINGS

FIG. 13 illustrates the relationship between the seeding timing and the change of physical properties;

BEST MODE FOR CARRYING OUT THE INVENTION

The metal material and the method of producing the same according to the present invention will be explained in detail below with reference to the accompanying drawings as exemplified by preferred embodiments.

Figure 1:
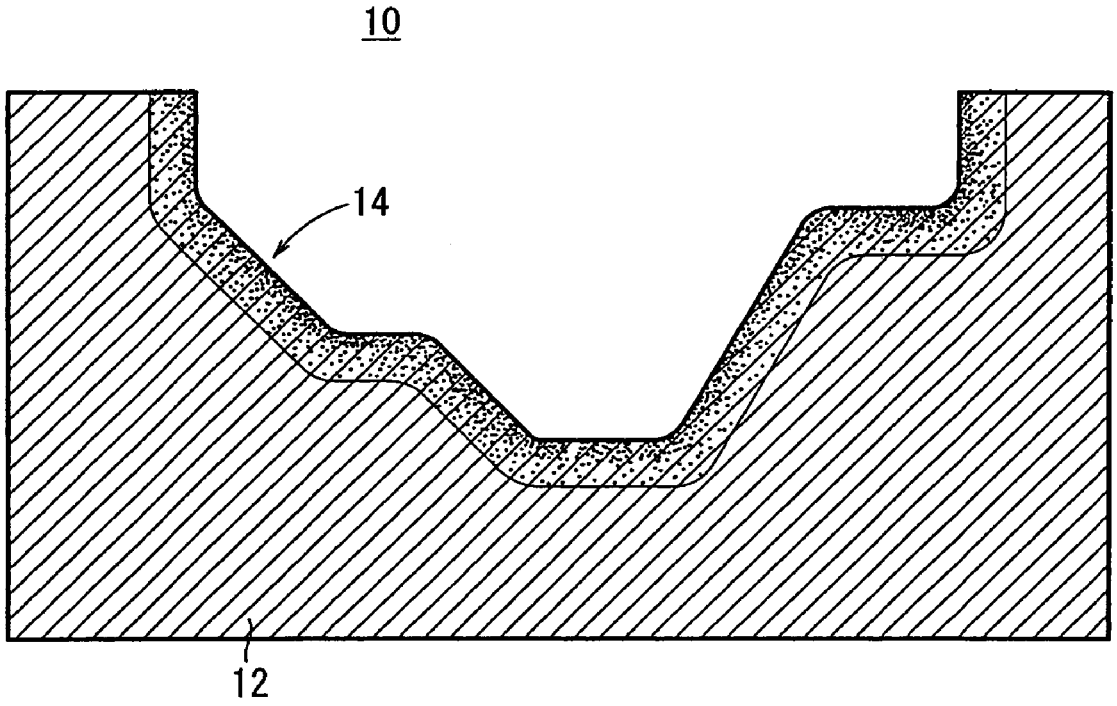
FIG. 1 schematically illustrates, in cross section, a die of a metal material according to a first embodiment of the present invention.

At first, FIG. 1 schematically illustrates, in cross section, a die 10 of a metal material according to a first embodiment of the present invention. In the die 10, one or more elements are diffused into a base material 12, and a diffusion layer 14 is formed thereby. Preferred metal materials of the base material 12 may include Zn alloy, Al alloy, Mg alloy, Cu alloy, Ti alloy, and Fe alloy which are widely used as alloys of practical use. However, there is no special limitation thereto.

The most diffused element in the base material 12 of the metal material as described above arrives at a depth from the surface of the base material 12 of at least 0.5 mm (500 μm). The depth may be 2 cm (2000 μm) at the maximum. This value is remarkably large as compared with several tens of μm or about 200 μm of the diffusion distance of the element achieved, for example, by the conventional nitriding and the carburization methods. That is, the diffusion distance of the element achieved in the present invention has the remarkably large value as compared with the diffusion distance of the element by the conventional surface treatment method.

The type of the element to be diffused depends on the type of the metal material to serve as the base material 12. Selected elements are capable of improving various characteristics of the metal material. For example, when the base material 12 is composed of Zn alloy, it is possible to select at least any one of Cu and Mn. In this case, the diffusion layer 14 may further contain at least one of Fe, Ni, Cr, Mo, Co, and ceramics.

When the base material 12 is composed of Fe alloy, Cr may be diffused. When the base material 12 is composed of Ti alloy, at least any one of Al, Cr, Ni, and N may be diffused. When the base material 12 is composed of Cu alloy, Ni may be diffused.

The form of the element, which exists after the diffusion into the die 10, is not specifically limited. That is, the element may form an alloy together with the metal material of the base material 12. Alternatively, the element may form a compound together with any impurity contained in the metal material. Further alternatively, the element may form a solid solution singly.

As described later on, the element is diffused from the surface of the base material 12. Therefore, the concentration of the element in the diffusion layer 14 is the highest at the surface, and the concentration is gradually decreased inwardly. In FIG. 1, a boundary line is depicted between the diffusion layer 14 and the base material 12 for illustration purpose. However, actually, distinct interface does not exist between the diffusion layer 14 and the base material 12.

In the die 10 as described above, various characteristics of the base material 12 are improved over the region where the diffusion layer 14 exists, in other words, to the depth to which the element has been diffused. For example, when Cu is diffused into the base material 12 of Zn—Al, Zn—Sn, or Zn—Al—Sn alloy (so-called ZAS alloy) as the Zn alloy, Cu is bonded to Zn to form Cu—Zn alloy (brass). Both of the strength and the hardness of the brass are twice or more, compared with the strength and the hardness of Zn. Further, the brass is excellent in corrosion resistance. Furthermore, the melting point of the brass is twice or more, compared with the melting point of Zn. Therefore, the melting point is raised owing to the production of the brass. As a result, the heat resistance is improved. Consequently, the obtained diffusion layer 14 is excellent in various characteristics such as the strength, the hardness, the corrosion resistance, and the heat resistance.

In the die 10, no distinct interface exists between the diffusion layer 14 and the base material 12. Accordingly, the occurrence of stress concentration is avoided. Therefore, it is also possible to suppress the increase in brittleness or fragility which would be otherwise increased when the element is diffused.

When Fe, Ni, Cr, Mo, or Co is further contained in the diffusion layer 14, each of the elements improves the strength, the hardness, and the corrosion resistance of the Zn alloy. When some ceramics are added, the strength and the hardness are improved, and the abrasion resistance is improved. Therefore, the diffusion layer 14 can be reliably obtained, which is excellent in hardness, strength, corrosion resistance, or the like as compared with the base material 12.

Further, Cu functions as an excellent binder for Fe, Ni, Cr, Mo, Co, or ceramics. Accordingly, it is possible to provide the diffusion layer 14 which has the high corrosion resistance and the abrasion resistance.

Figure 2:
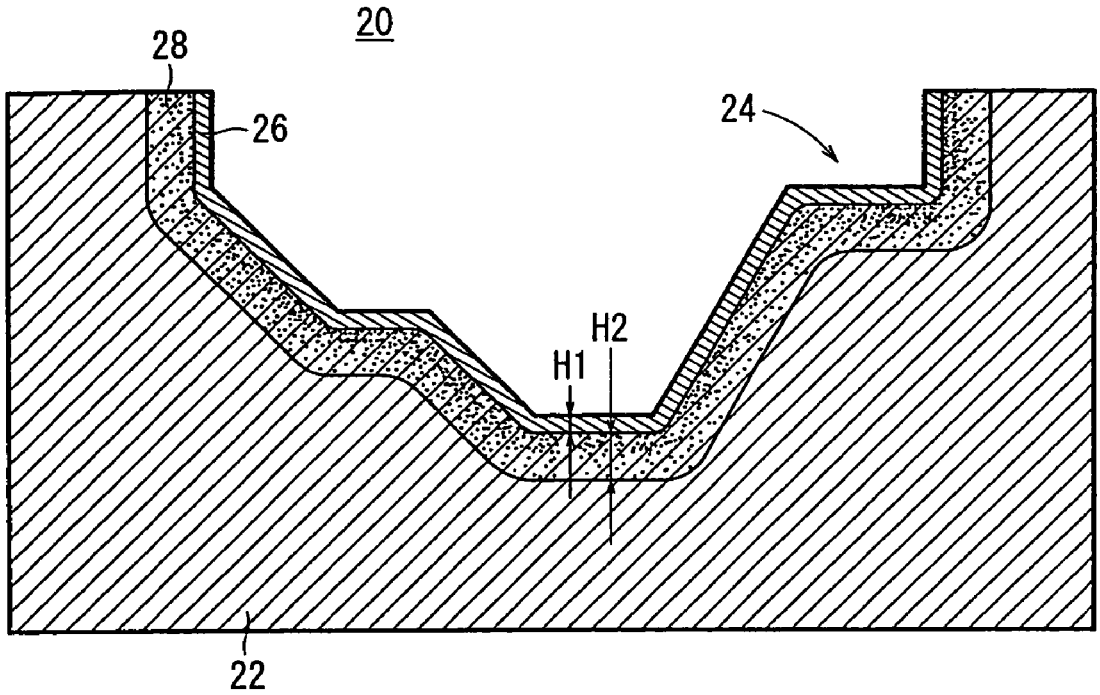
FIG. 2 schematically illustrates, in cross section, a die of a metal material according to a second embodiment of the present invention.

FIG. 2 schematically illustrates, in cross section, a die 20 of a metal material according to a second embodiment. The die 20 has a base material 22 which is composed of ZAS alloy, and an alloy layer 24 which is harder than the base material 22. In particular, the alloy layer 24 is composed of an Fe alloy layer 26 formed near the surface, and a diffusion layer 28 which is formed between the Fe alloy layer 26 and the base material 22.

The Fe alloy layer 26 is formed so that the thickness H1 is within a range of 0.5 mm to 1.5 mm from the surface. On the other hand, the diffusion layer 28 contains at least any one of Cu and Mn. A brass layer is provided near the Fe alloy layer 26. The brass layer is selected from Zn—Cu, Zn—Mn—Cu, Zn—Al—Cu, Zn—Al—Cu—Mn, Zn—Sn—Cu, Zn—Sn—Cu—Mn, Zn—Sn—Al—Cu, and Zn—Sn—Al—Mn—Cu, for example. An Mn alloy layer is provided in the brass layer. The Mn alloy layer is selected from Zn—Mn, Zn—Sn—Mn, Zn—Al—Mn, and Zn—Al—Sn—Mn, for example. The diffusion layer 28 is designed so that the thickness H2 starting from the inner boundary line of the Fe alloy layer 26, is within a range of 0.5 mm to 30 mm.

In this arrangement, an alloy layer 24 provided with the Fe alloy layer 26 and the diffusion layer 28 is formed on the surface of the base material 22. In other words, the Fe alloy layer 26 is provided as the surface layer of the die 20. Accordingly, the melting point, the strength, the hardness, and the heat resistance are remarkably improved on the surface of the die 20 as compared with the Zn alloy as the base material 22. As a result, it is possible to reliably improve various characteristics such as the abrasion resistance, the heat resistance, and the shock resistance.

Further, the diffusion layer 28 exists as the intermediate layer between the Fe alloy layer 26 and the base material 22. The diffusion layer 28 contains the brass layer including Cu and Zn. Therefore, the melting point, the strength, the hardness, and the heat resistance of the diffusion layer 28 are improved as compared with the Zn alloy as the base material 22.

In this arrangement, when the component ratio in the diffusion layer 28 is gradually changed, then no interface exists, and the exfoliation and the stress concentration, which would be otherwise caused by the difference in thermal expansion, can be effectively avoided. Accordingly, it is possible to use the die 20 favorably for a long period of time, so that the die 20 is extremely economical.

The Fe alloy layer 26 is formed inwardly from the surface within a range such that the thickness H1 is 0.5 mm to 1.5 mm. Further, the diffusion layer 28 is formed inwardly from the Fe alloy layer 26 within a range such that the thickness H2 is 0.5 mm to 30 mm. Accordingly, it is possible to reliably avoid the occurrence of, for example, the breakage and the crack especially during the use of the thermal cycle, as compared with a case in which a coating treatment such as the plating, CVD, PVD, and the anodic oxidation is applied to the base material 22.

If the thickness H1 of the Fe alloy layer 26 is less than 0.5 mm, the physical properties are not improved. On the other hand, if the thickness H1 exceeds 1.5 mm, the processability is deteriorated. If the thickness H2 of the diffusion layer 28 is less than 0.5 mm, the physical properties are not improved. On the other hand, if the thickness H2 exceeds 30 mm, then the diffusion requires a long period of time, and it is impossible to realize efficient production.

Next, the method of producing the die 10, 20 will be explained, as exemplified by a case in which Cu is diffused in the ZAS alloy.

Figure 3:
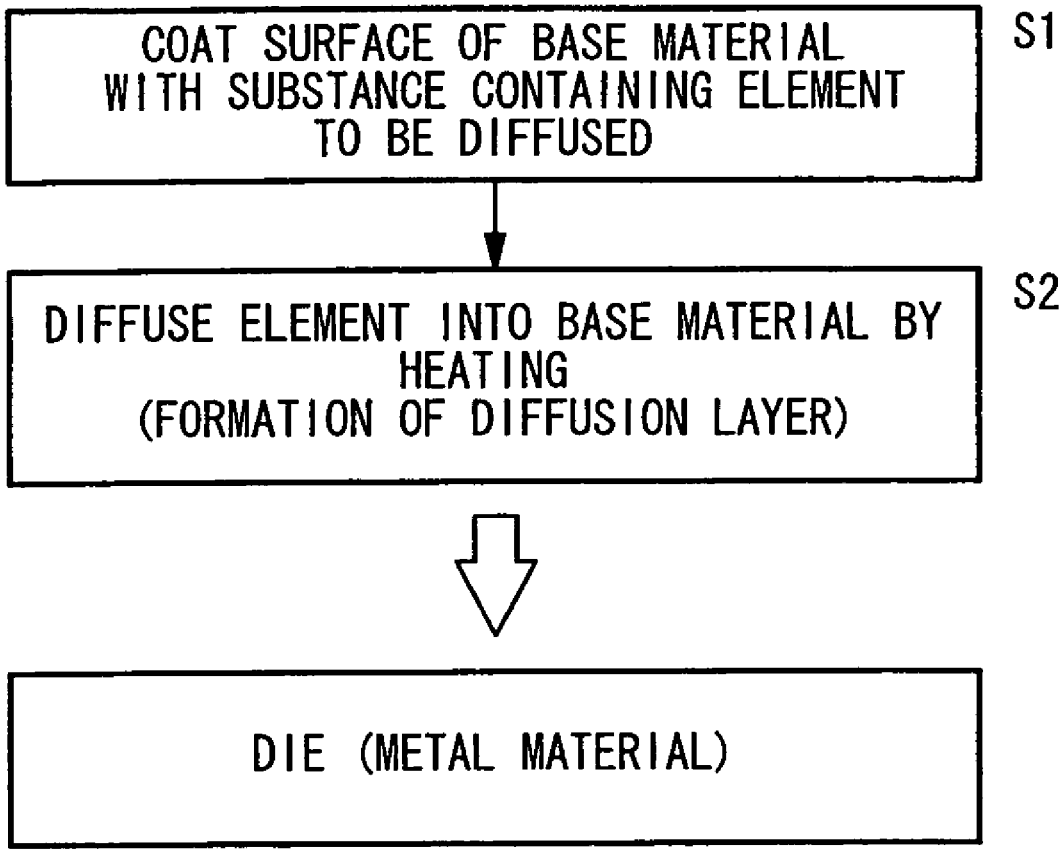
FIG. 3 is a flow chart illustrating a method of producing the die of the metal material according to the first embodiment.

FIG. 3 is a flow chart of the production method to obtain the die 10. The production method comprises a first step S1 of coating a surface of a base material with a substance containing an element to be diffused, and a second step S2 of diffusing the element into the base material by heating.

Figure 4:
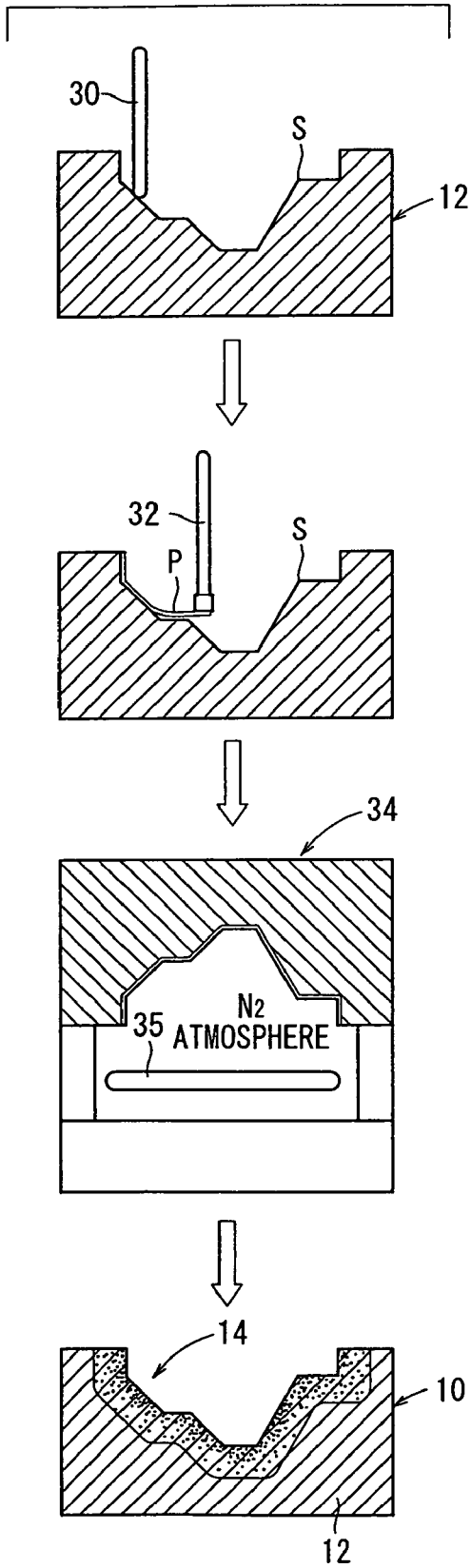
FIG. 4 illustrates steps of removing an oxide film formed on a surface of a ZAS alloy (Zn alloy) as a base material.

At first, as shown in FIG. 4, a machining treatment is applied to the base material 12 (ZAS alloy) by using a processing machine 30 to form a semimanufactured product having a shape corresponding to the die 10.

On the other hand, a processed surface S of the semimanufactured product is coated with a coating agent P in the first step S1. As for the solvent of the coating agent P, it is preferable to select an organic solvent which is readily volatile, such as acetone and alcohol. The substance containing Cu is dispersed in the solvent.

The substance containing Cu is exemplified, for example, by Cu powder and Cu—Mn alloy powder. In particular, it is preferable to select Cu—Mn alloy powder in view of the fact that this substance has a relatively low melting point, for the following reason. When this substance is selected, Cu can be dispersed at a lower temperature, in other words, with a smaller amount of thermal energy. As for the Cu—Mn alloy, for example, it is possible to use one in which the composition ratio between Cu and Mn is 6:4 in molar ratio.

Usually, an oxide film is formed on the surface of the ZAS alloy. In order to diffuse Cu in this state, it is necessary to supply an extremely large amount of thermal energy so that Cu is successfully passes through the oxide film. In order to avoid this inconvenience, it is preferable that a reducing agent for reducing the oxide film is mixed with the coating agent P.

Specifically, a substance, which acts as the reducing agent on the oxide film and which does not react with the ZAS alloy, is dispersed or dissolved in the solvent. Preferred examples of the reducing agent may include each of resins of nitrocellulose, polyvinyl alcohol, polyvinyl, acrylic, melamine, styrene, and phenol. However, there is no special limitation thereto. The concentration of the reducing agent may be about 5%.

It is preferable that a powder of at least any one of Mg, Mg alloy, Al, Al alloy, Mn, and Mn alloy is further added to the coating agent P, for the following reason. Each of Mg, Al, and Mn is promptly bonded to O as compared with Zn. Therefore, it is possible to avoid the oxidation of the Zn alloy again after reducing and removing the oxide film.

It is preferable that at least one of the metals described above is mixed with a metal with which oxygen is diffused more promptly. Such a metal is at least one of Ni, Sn, and Cu. It is desirable that the metal is mixed or alloyed to be formed into a powdery form. As for such a metal, the diffusion of oxygen in the metal is caused extremely quickly within a temperature range of 250° to 350° C. It is possible to greatly improve the alloy formation efficiency and the alloy formation speed. When the alloy formation is advanced, the melting point is raised as well, the heating at temperatures of not less than 350° C. is advanced, and the alloy formation is further facilitated.

When Fe, Ni, Cr, Mo, Co, or ceramics is further contained in the diffusion layer 14 (see FIG. 1), a powder of each of them may be further added to the coating agent P.

With the coating agent P, which has been prepared by mixing the materials as described above, the processed surface S is coated with a coating machine 32. After that, in the second step S2, the heat is applied to the ZAS alloy to which the coating agent P has been applied. That is, the semimanufactured product, which is coated with the coating agent, is arranged in a heating apparatus 34. The semimanufactured product is heated by using a heating source 35 such as a burner or a heater in an inert atmosphere such as a nitrogen ($N_2$) gas atmosphere.

In this procedure, the semimanufactured product may be heated in a state in which a temperature gradient is provided in the second step S2. That is, a plate member for avoiding any excessive heating abuts against one end surface of the semimanufactured product. In this state, the semimanufactured product may be heated from another end surface opposite to the end surface where the plate member abuts. The heat is absorbed by the plate member as described later on. Therefore, Cu can be diffused without melting the semimanufactured product.

During the process in which the temperature is raised, the reducing agent begins to be decomposed at about 250° C., and carbon and hydrogen are produced. The oxide film formed on the surface of the semimanufactured product disappears as a result of the reduction by the carbon and hydrogen. Accordingly, it is unnecessary for Cu to pass through the oxide film. Therefore, it is possible to shorten the time required for the diffusion, and it is possible to reduce the thermal energy required.

Further, in this procedure, it is unnecessary to use any special exclusive equipment unlike the procedure of reduction with hydrogen. The oxide film formed on the base material 12 can be reliably removed by means of the simple construction and the steps.

When at least one metal powder of Mg, Al, and Mn, or an alloy powder of each of them is added to the coating agent P, the powder promptly reacts with oxygen as compared with Zn which is the major component of the base material 12 (ZAS alloy). Therefore, it is possible to avoid the oxidation of Zn again, and the diffusion preformed thereafter is smoothly advanced.

When the temperature is continuously raised, Cu begins to diffuse into the semimanufactured product (ZAS alloy). When the Cu—Mn alloy powder is applied, the diffusion is started at a low temperature as compared with a case in which the Cu powder is used. As a result of the diffusion, the diffusion layer 14 is formed, and the die 10 is finally obtained.

The diffused Cu is ultimately bonded, for example, to Zn of the ZAS alloy to form the Cu—Zn alloy. As a result, the melting point of the ZAS alloy (die 10) is raised. Therefore, the die 10 is not melted.

When the plate member abuts against one end surface, the heat supplied to the die 10 is transmitted to the plate member, and then the heat is consumed by raising the temperature of the plate member. In other words, the heat is absorbed by the plate member. Accordingly, it is possible to efficiently diffuse Cu without melting the die 10.

The degree of the diffusion of the element also depends on the shape of the base material to be heated. For example, when the ZAS alloy is a cube of 100 mm×100 mm×100 mm, it is possible to diffuse Cu to a depth of about 1.5 mm from the surface of the cube. The concentration of Cu is gradually decreased. No distinct interface appears between the ZAS alloy and the end of the diffusion of Cu as well.

The hardness and the strength are remarkably improved in the die 10 (Cu-diffused ZAS alloy) obtained as described above, as compared with a die of only the ZAS alloy (only the base material 12) in which Cu is not diffused. Specifically, the Vickers hardness (Hv) of the surface of the base material 12 is about 120, and the tensile strength thereof is about 200 MPa. On the other hand, in the case of the Cu-diffused ZAS alloy (die 10), Hv of the surface and the tensile strength are about 250 and about 450 Mpa, respectively, both of which are about twice the above.

Mn can also be diffused in the ZAS alloy in the same manner as described above.

When Cr is diffused in an Fe alloy represented, for example, by S45C (JIS Standard), the following procedure may be adopted. An acrylic resin monomer is dissolved in acetone so that the concentration is 0.5%. A mixed powder, in which respective powders of Cr, Mo, Ni, C, and BN are mixed in a ratio (weight ratio) of 2:3:4:0.5:0.5, is dispersed therein to prepare a coating agent.

S45C is coated with the coating agent (first step S1), and then a heat is applied in an electric furnace (second step S2). S45C is a high melting point substance, and it is hardly melted. Therefore, the heating temperature can be about 1200° C. The temperature may be retained for about 1 hour.

When the heat is applied in the electric furnace, it is preferable to use an inert atmosphere of, for example, nitrogen or argon. Accordingly, it is possible to avoid the oxidation of the surface of S45C.

In this procedure, it is especially unnecessary that the plate member abuts against one end surface of the base material in order to avoid any excessive heating, for the following reason. S45C is the high melting point substance as described above, and hence it is especially unnecessary to absorb the heat in order to prevent S45C from being melted during the heat treatment at the high temperature. For the reason described above, it is preferable that the second step S2 is carried out in the inert atmosphere.

After the completion of the second step S2, chromium carbonitride is produced on the surface of S45C, and Cr is diffused in S45C. In this case, Cr is diffused to a depth of 1.8 mm from the surface. The concentration thereof is gradually decreased, and no interface appears between Cr and S45C.

The surface of the Cr-diffused S45C obtained as described above has Hv of 650 which is an extremely high value.

The volume change before and after the second step S2 is remarkably suppressed to be 0.216%, because of the production of chromium carbonitride on the surface. The strain energy accumulated in this process is approximately calculated to be about 102 MPam. This indicates that the large strain energy can be accumulated in the hardening operation and the tempering operation.

Next, an explanation will be made about an example of diffusion of Al, Cr, Ni, and N in Ti-6Al-4V alloy.

A coating agent, with which the surface of the Ti-6Al-4V alloy is coated, is prepared in the first step S1 in the same manner as described above. In this procedure, a powder of metal element which readily forms an intermetallic compound together with Ti in the Ti alloy, for example, a mixed powder of Al, Cr, and Ni powders may be dispersed, in acetone or alcohol.

An oxide film also exists on the surface of the Ti-6Al-4V alloy. Accordingly, also in this case, it is preferable that the coating agent is mixed with a reducing agent capable of reducing the oxide film, for example, a powdery carbon material.

Further, a BN powder may also be mixed with the coating agent, since $TiB_2$ which is a boride of Ti is obtained. The hardness of the alloy can be improved by dispersing $TiB_2$ in the Ti-6Al-4V alloy as the base material.

In view of the fact described above, it is preferable in this procedure to use the coating agent containing the powder mixed with the Al powder, the Cr powder, the Ni powder, the C powder, and the BN powder, for example, in a ratio (weight ratio) of 30:10:50:5:5.

The surface of the Ti-6Al-4V is coated with the coating agent to have a thickness of about 0.5 mm by means of the known coating technique such as the brush coating method. After that, the heat is applied in the second step S2 in the same manner as described above. The heat treatment may be carried out, for example, in a heat treatment furnace which is a nitrogen atmosphere.

In this procedure, the temperature is raised at a speed of 10° C./minute while allowing nitrogen to flow so that the pressure is 10 Pa, and the temperature is retained for 30 minutes at 250° C., 450° C., and 650° C., respectively. After that, the pressure is changed to 0.3 MPa, the temperature is raised up to 777° C. at 5° C./minute, and the temperature is retained for 1 hour so that the heat may be applied. Accordingly, the oxide film on the surface of the Ti-6Al-4V alloy is reduced. The metal elements contained in the coating agent and N originating from nitrogen in the atmosphere can be reliably diffused into the alloy.

The diffused element, for example, Al is ultimately bonded, for example, to Ti of the Ti-6Al-4V alloy to form Al—Ti alloy. Further, for example, chromium nitride and titanium nitride are produced in accordance with the nitriding of Cr and Ti remaining on the surface. Furthermore, $TiB_2$ is produced as a result of bonding between Ti and B. As a result, a diffusion layer of ceramics or alloy is formed in the Ti-6Al-4V alloy after the heat treatment.

When the Ti-6Al-4V alloy has a columnar shape having a diameter of 15 mm and a length of 100 mm, the alloy of Ti and Al, Cr or Ni can be produced to a depth of about 2.3 mm from the surface of the column by the heat treatment as described above. Further, it is possible to produce chromium nitride, titanium nitride, and $TiB_2$. The concentration of the alloy or the ceramics is gradually decreased. No distinct interface appears between the Ti-6Al-4V alloy and the end of the diffusion of the alloy or the ceramics as well.

Also in this case, various characteristics are remarkably improved as compared with the Ti-6Al-4V alloy before the diffusion. Specifically, Hv of the surface of the Ti-6Al-4V alloy before the diffusion is about 300. On the other hand, Hv of the Ti-6Al-4V alloy after the diffusion is 1200.

Figure 5:
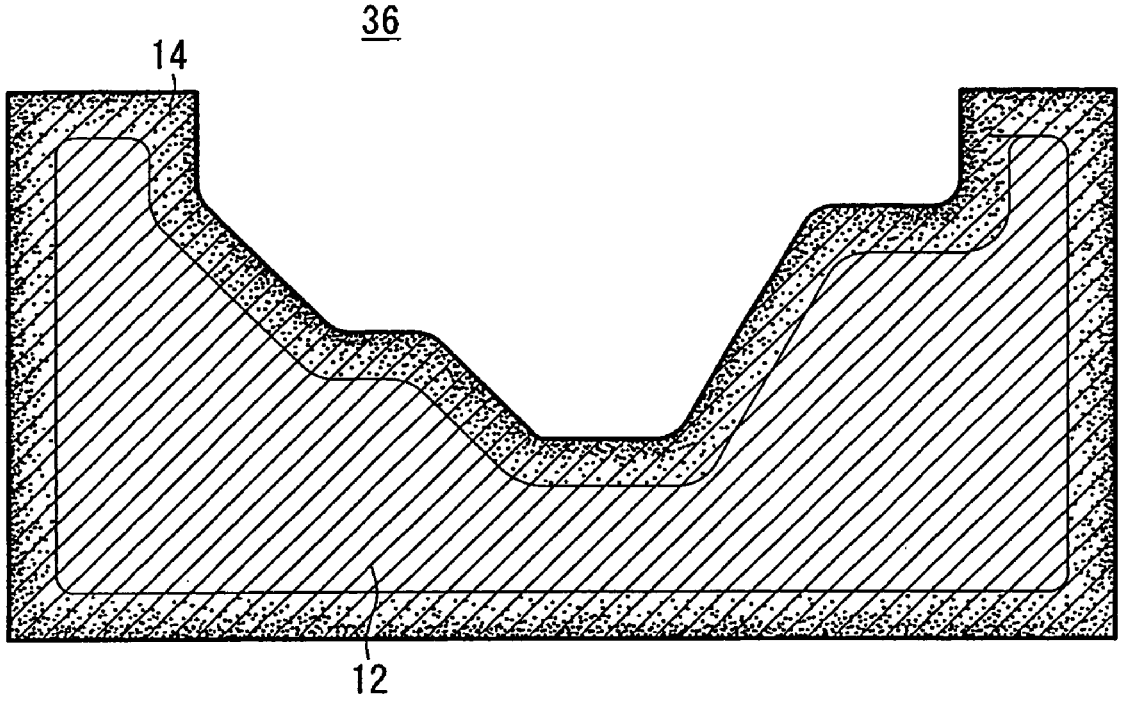
FIG. 5 schematically illustrates, in cross section, a die produced by a production method according to another embodiment of the present invention.
Figure 6:
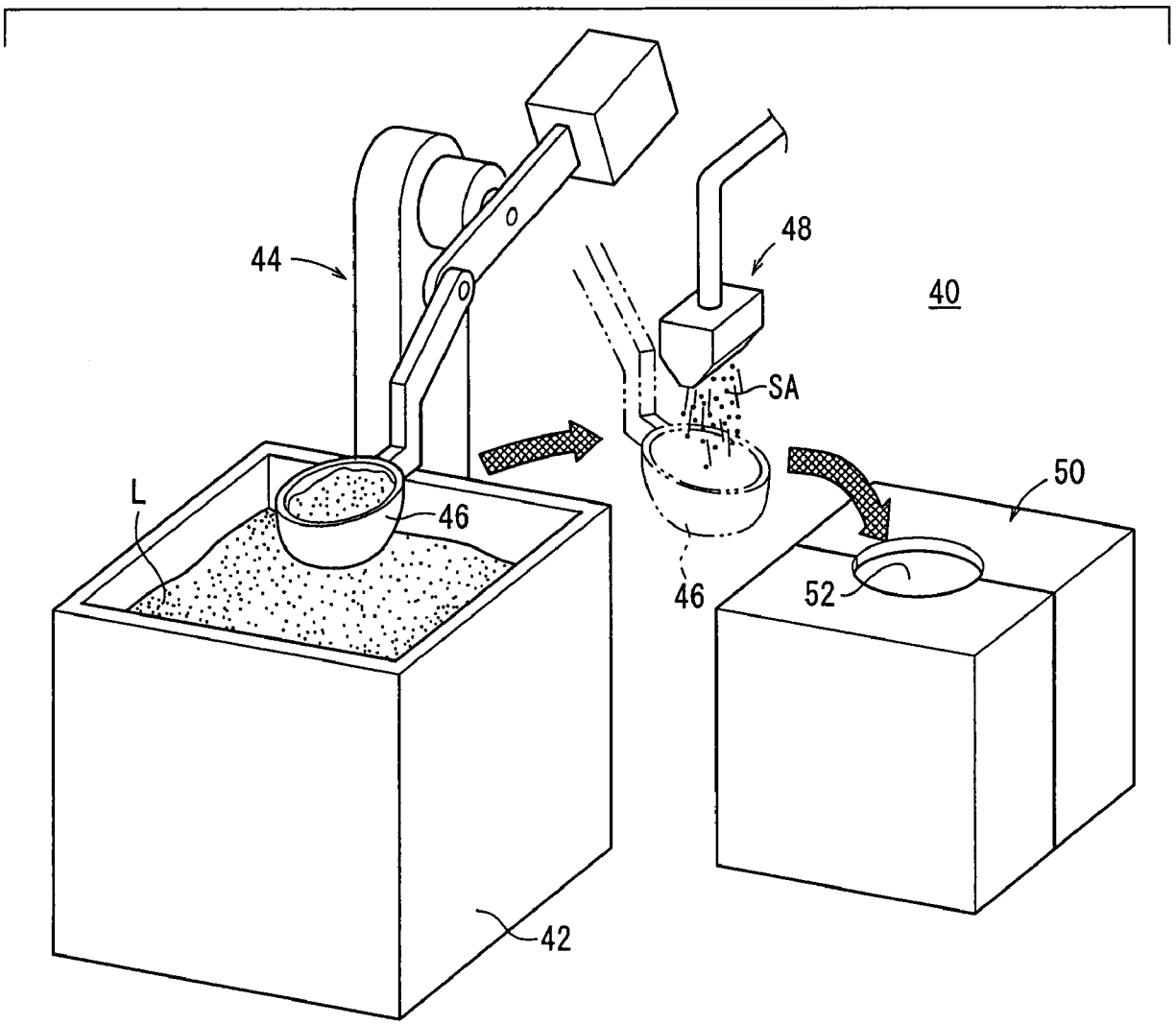
FIG. 6 schematically illustrates a casting apparatus used for the method of producing the die shown in FIG. 5.
Figure 7:
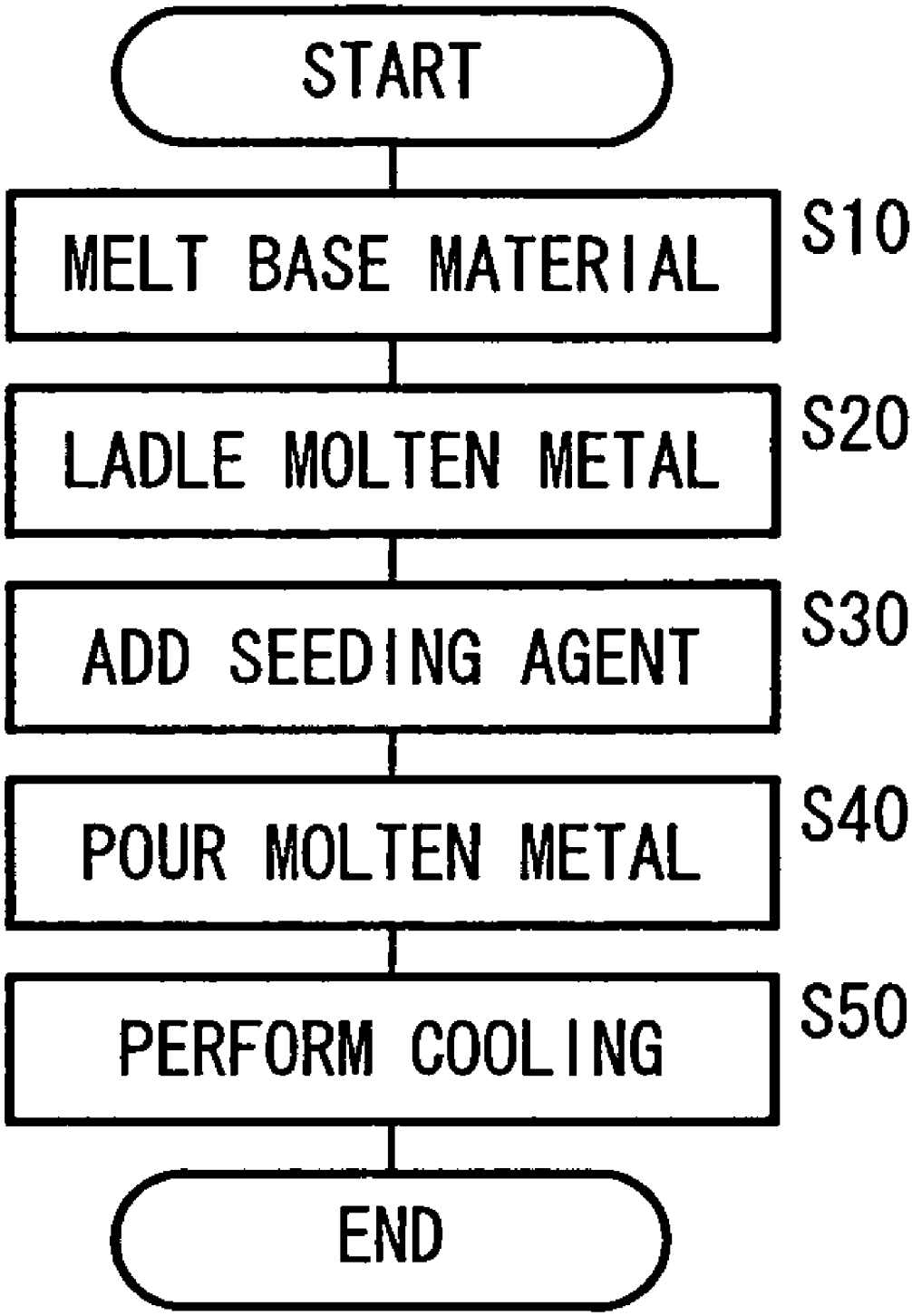
FIG. 7 is a flow chart illustrating the method of producing the die shown in FIG. 5.

As shown in FIG. 5, the diffusion layer 14 can also be formed over the entire surface of a die 36. In this case, the product can also be manufactured by means of the casting with a casting apparatus 40 as shown in FIGS. 6 and 7. The casting apparatus 40, which is schematically illustrated in FIG. 6, comprises a molten metal-holding furnace 42 for holding the molten metal L of melted metal of ZAS alloy, a molten metal-ladling mechanism 44 for ladling the molten metal L in a predetermined amount (amount of one shot) from the inside of the molten metal-holding furnace 42, a seeding agent-adding mechanism 48 for adding a seeding agent SA to the molten metal L ladled by a ladle 46 of the molten metal-ladling mechanism 44, and a mold 50 for molding the molten metal L added with the seeding agent SA to have a shape of the die 36.

The seeding agent SA contains at least any one of Cu and Mn, preferably both of them. Cu and Mn are pulverized into powdery forms having particle sizes of 10 μm to 50 μm, more preferably 10 μm to 20 μm respectively. If the particle size is less than 10 μm, the alloy formation is excessively advanced, and the diffusion tends to be excessively advanced. Therefore, the effect to improve various characteristics is inferior. On the other hand, if the particle size exceeds 50 μm, the die 36 may suffer from the roughness and the defect of the cast texture.

It is preferable that the seeding amount of Cu is 1% by weight to 18% by weight with respect to the entire ZAS alloy. If the seeding amount is less than 1% by weight, then the diffusion tends to be excessively advanced, and hence the effect to improve various characteristics is inferior. On the other hand, if the seeding amount exceeds 18% by weight, then the molten metal L is quickly cooled, and the quality of the obtained cast product may be lowered. More preferably the seeding amount of Cu is 3% by weight to 7% by weight. Within this range, the alloy formation occurs in the vicinity of the surface of the cast product (die 36) to a depth of several mm to several tens mm. No crystal grain of zinc or Zn—Al—Sn alloy is observed, which is satisfactory.

On the other hand, the seeding amount of Mn is set to be 3% by weight to 30% by weight of the seeding agent SA. If the seeding amount is less than 3% by weight, no sufficient effect is obtained. If the seeding amount exceeds 30% by weight, unreacted matters are consequently aggregated. The physical properties of the alloy layer 14 may be deteriorated to cause some defect in the die.

An explanation will be made below with reference to a flow chart shown in FIG. 7 about a method of producing the die 36 constructed as described above.

At first, as shown in FIG. 6, the molten metal L of melted metal of the ZAS alloy is held in the molten metal-holding furnace 42 (step S10). When the molten metal-ladling mechanism 44 is operated, the ladle 46, which is inserted into the molten metal-holding furnace 42, is inclined. Accordingly, the molten metal L in an amount of one shot is ladled by the ladle 46 (step S20).

The ladle 46, with which the molten metal L has been ladled, is moved to the position for the addition by the seeding agent-adding mechanism 48. The seeding agent SA in the predetermined amount is supplied from the seeding agent-adding mechanism 48 to the molten metal L contained in the ladle 46 (step S30). The molten metal-ladling mechanism 44 starts the poring of the molten metal into a pouring port 52 of the mold 50 in 10 to 30 seconds after performing the addition of the seeding agent SA (step S40). Accordingly, an unillustrated cavity in the mold 50 is filled with the molten metal L added with the seeding agent SA.

After that, a predetermined cooling treatment is applied. Accordingly, the die 36 is obtained as the cast formed product (step S50).

As described above, the seeding agent SA, which contains Cu or Mn, is added to the molten metal L. Therefore, the diffusion layer 14 of brass such as Zn—Cu, Zn—Mn—Cu, Zn—Al—Cu, Zn—Al—Cu—Mn, Zn—Sn—Cu, Zn—Sn—Cu—Mn, Zn—Sn—Al—Cu, and Zn—Sn—Al—Mn—Cu is formed as the surface layer of the manufactured die 36.

In this case, it is possible to manufacture the die 36 with ease by means of the casting. Further, it is possible to lower the melting temperature as compared with a case in which the casting is performed by using a material in which copper, manganese, or the like is previously mixed with the ZAS alloy. It is possible to reduce the amount of energy consumption.

The molten metal L is poured into the mold 50 in 10 to 30 seconds after the addition of the seeding agent SA. Accordingly, the seeding agent SA is sufficiently diffused in the molten metal L. As a result, the alloy layer 14 is formed in the die 36 within a range of about several mm to 25 mm in the direction directed inwardly from the surface. If the pouring of the molten metal L is performed at a timing less than 10 seconds after the seeding, the seeding agent SA (copper and/or manganese) is not diffused sufficiently in the molten metal L. Therefore, it is impossible to obtain any necessary hardness. On the other hand, if the timing exceeds 30 seconds after the seeding, crystal grains are grown, resulting in the decrease in hardness.

In the case of the above, the ladle 46, with which the molten metal L has been ladled, is moved to the position of the addition by the seeding agent-adding mechanism 48, and the predetermined amount of the seeding agent SA is supplied from the seeding agent-adding mechanism 48 to the molten metal L contained in the ladle 46. However, the seeding agent SA may be directly supplied to a mold passage which is communicated with a molten metal port or a molten metal passage provided for the mold 50.

Figure 8:
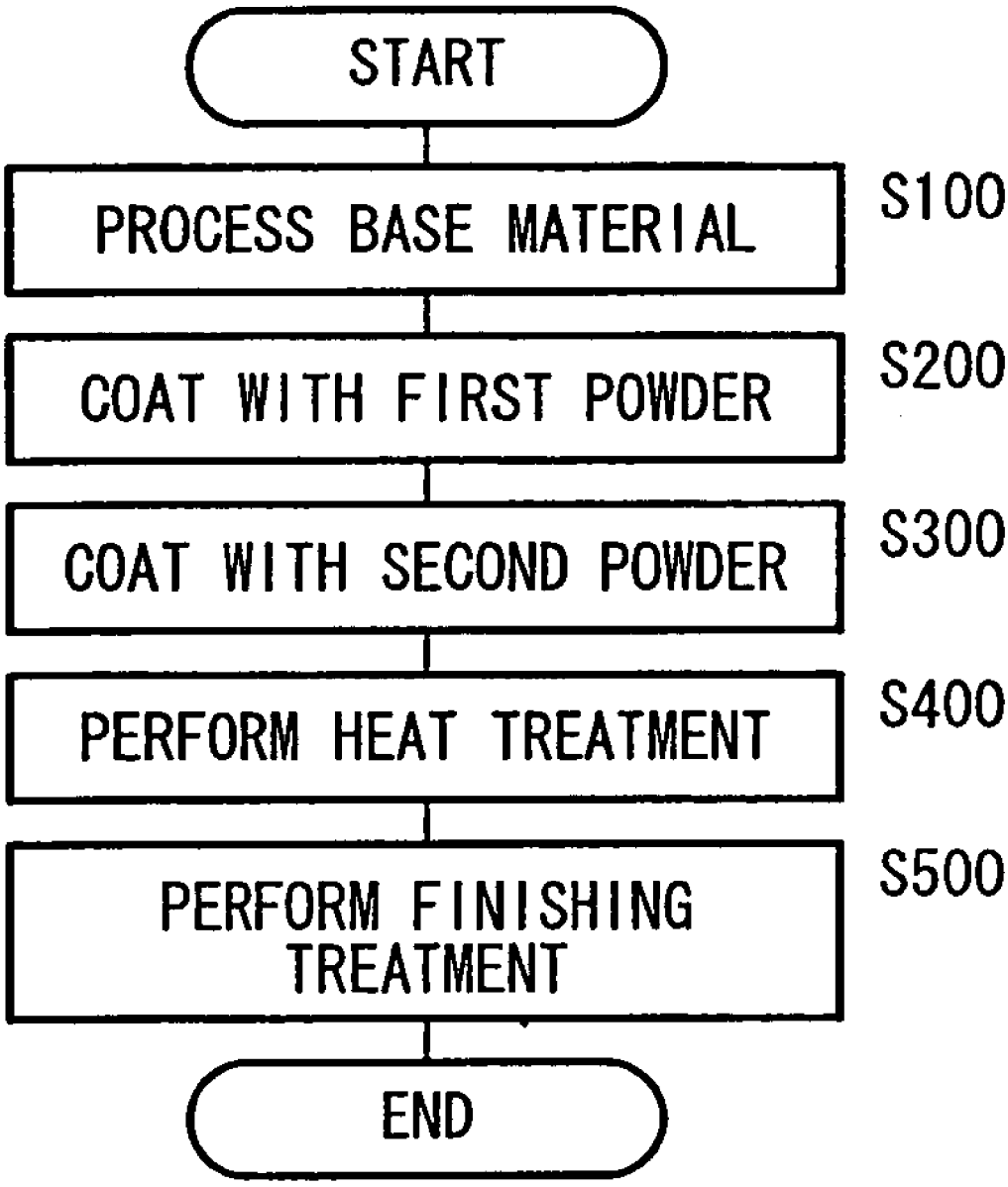
FIG. 8 is a flow chart illustrating a method of producing the die shown in FIG. 2.

Next, an explanation will be made about a method of producing the die 20 with reference to a flow chart shown in FIG. 8 and a step diagram shown in FIG. 9.

Figure 9:
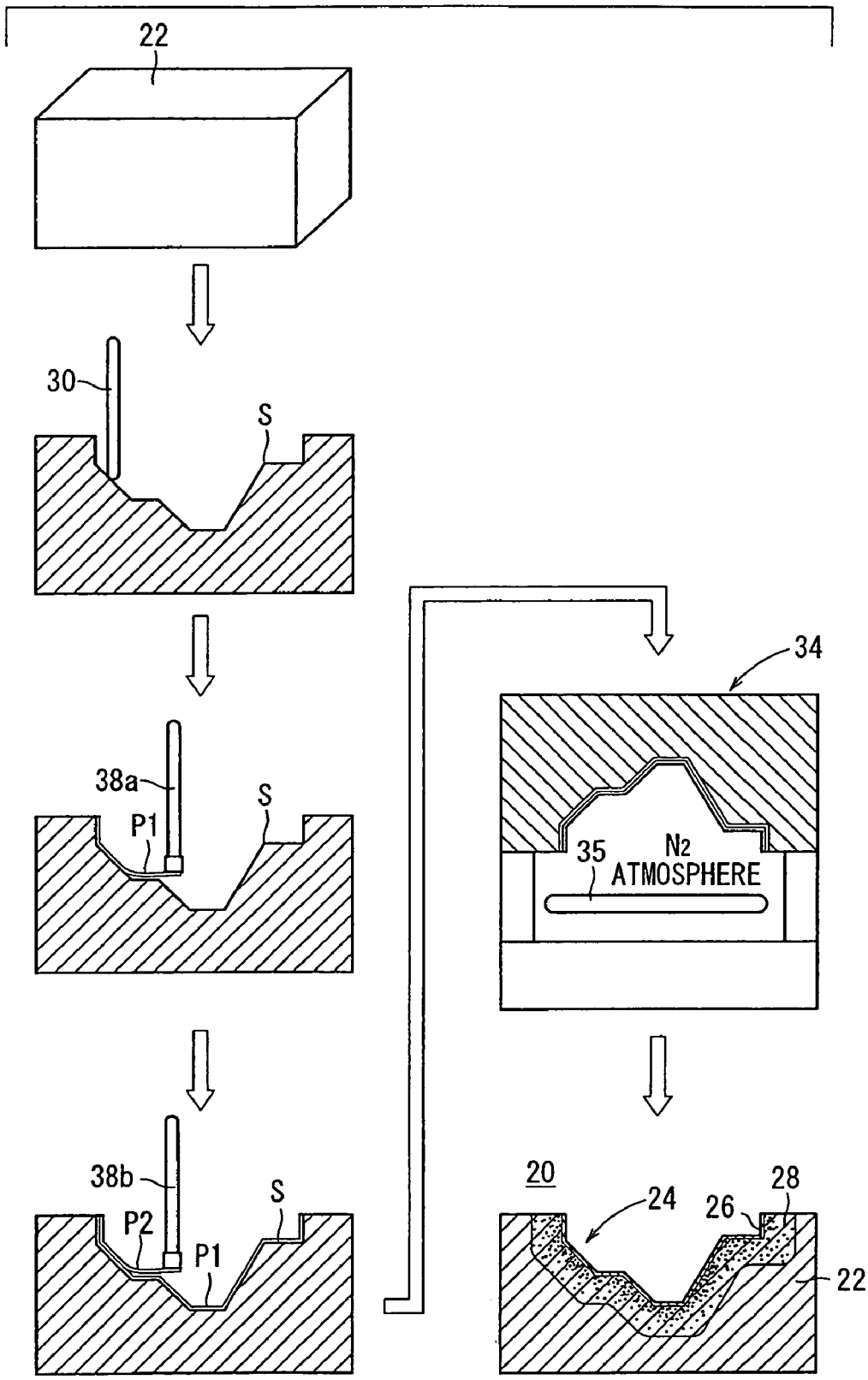
FIG. 9 shows steps of producing the die shown in FIG. 2.

At first, as shown in FIG. 9, a base material 22 made of ZAS alloy is prepared. A machining treatment is applied to the base material 22 by using a processing machine 30 (step S100). Accordingly, a semimanufactured product is formed with a processed surface S corresponding to a cavity and the semimanufactured product corresponds to the shape of the die 20.

Subsequently, the processed surface S is coated with a first paste P1 by using a first coating means 38*a* (step S200). The first paste P1 is mixed with at least one of Cu and Mn, which is prepared, for example, by diffusing Cu and Mn in a ratio of 4:6 to 6:4 in an organic solvent. A reducing agent and/or an oxygen-capturing agent may be contained in the first paste P1 as described above.

Subsequently, the first paste P1 is coated with a second paste P2 by using a second coating means 38*b* (step S300). The second paste P2 is prepared by diffusing an alloy containing a major component of Fe, Ni, Cr, Mo, or Co in an organic solvent.

Subsequently, the semimanufactured product, which is coated with the first paste P1 and the second paste P2, is arranged in a heating apparatus 34 in the same manner as described above. The die 20 is heated by using a heating source 35 such as a burner or a heater in an inert atmosphere, for example, in a nitrogen ($N_2$) gas atmosphere (step S400). Accordingly, the die 20, which has the alloy layer 24 of the Fe alloy layer 26 and the diffusion layer 28, is obtained. A finishing treatment such as a surface-polishing treatment is applied to the die 20 (step S500).

EXAMPLE 1

Figure 10:
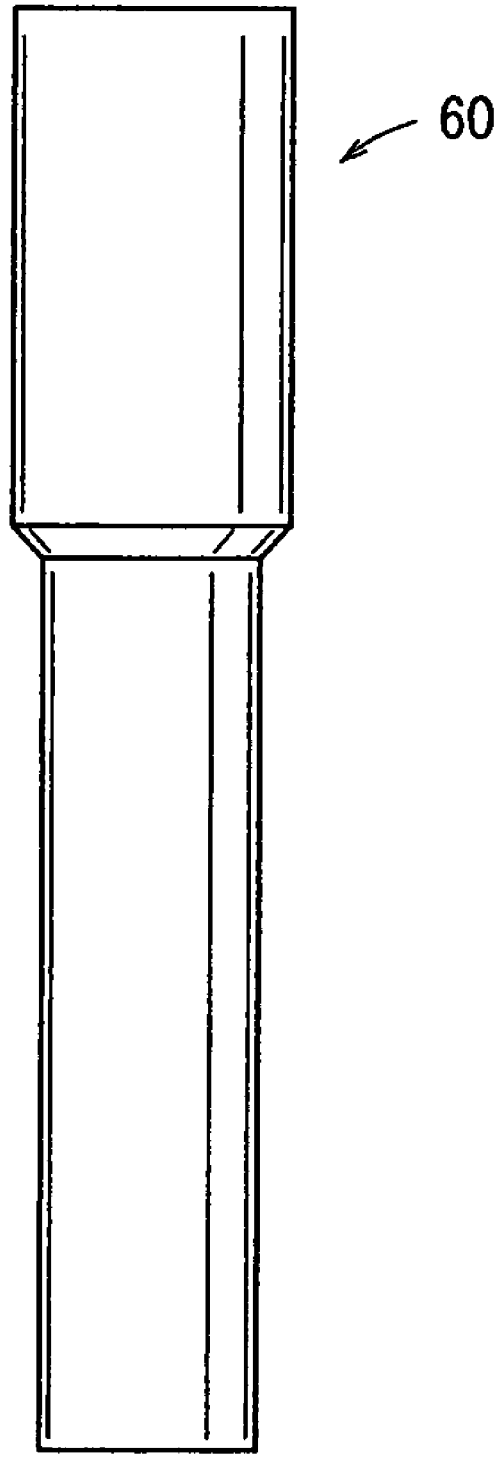
FIG. 10 is a schematic front view illustrating an entire test piece.

Test pieces 60 each having a stepped rod shape as shown in FIG. 10 were manufactured by using a base material 12 made of ZAS alloy.

Subsequently, powders A, B, C, D, E, and F having compositions (% by weight) shown in Table 1 were prepared, and the powders were dispersed in xylene respectively to prepare pasty coating agents. The surfaces of the test pieces 60 were coated with the coating agents A, B, C, D, E, and F to have thicknesses of about 0.3 mm, and then dried.

TABLE 1

| COMPOSITION | Cu | Ni | Cr | Co | Mo | Fe | Mn | CERAMICS | SURFACE HARDNESS (Hv) | ALLOY PORTION HARDNESS (Hv) |
|---|---|---|---|---|---|---|---|---|---|---|
| A | 50 | | | | | | 50 | | 320 | 180 |
| B | 40 | 10 | | | | | 50 | | 340 | 170 |
| C | 45 | 10 | 1 | | | | 44 | | 340 | 190 |
| D | 40 | 5 | 1 | | 10 | | 44 | | 350 | 180 |
| E | 40 | 5 | 1 | | 13 | 2 | 39 | | 370 | 180 |
| F | 40 | 5 | | 2 | | 5 | 40 | 8 | 426 | 180 |

Further, the respective dried test pieces 60 were heated for 60 minutes at 350° C. under the flow of nitrogen gas. After the heat treatment, the respective test pieces 60 were cut in central cross sections to confirm the thicknesses of the reacted portions under a metallurgical microscope and measure the surface hardness (Hv) and the alloy portion hardness (Hv) at the position inwardly from the outermost surface by 5 mm. Obtained results are also shown in Table 1.

On the other hand, a corrosion test with aluminum molten metal was carried out for the respective test pieces 60 prepared separately and another test piece 60 which was not coated with the pasty coating agent. Specifically, the respective test pieces 60 were immersed in the aluminum molten metal (corresponding to ADC12) heated to about 700° C., for 30 minutes, 60 minutes, and 90 minutes respectively. After that, the test pieces 60 were taken out of the aluminum molten metal, and they were cut in central cross sections. The change in shape was confirmed, and the corrosion situation was detected.

Figure 11:
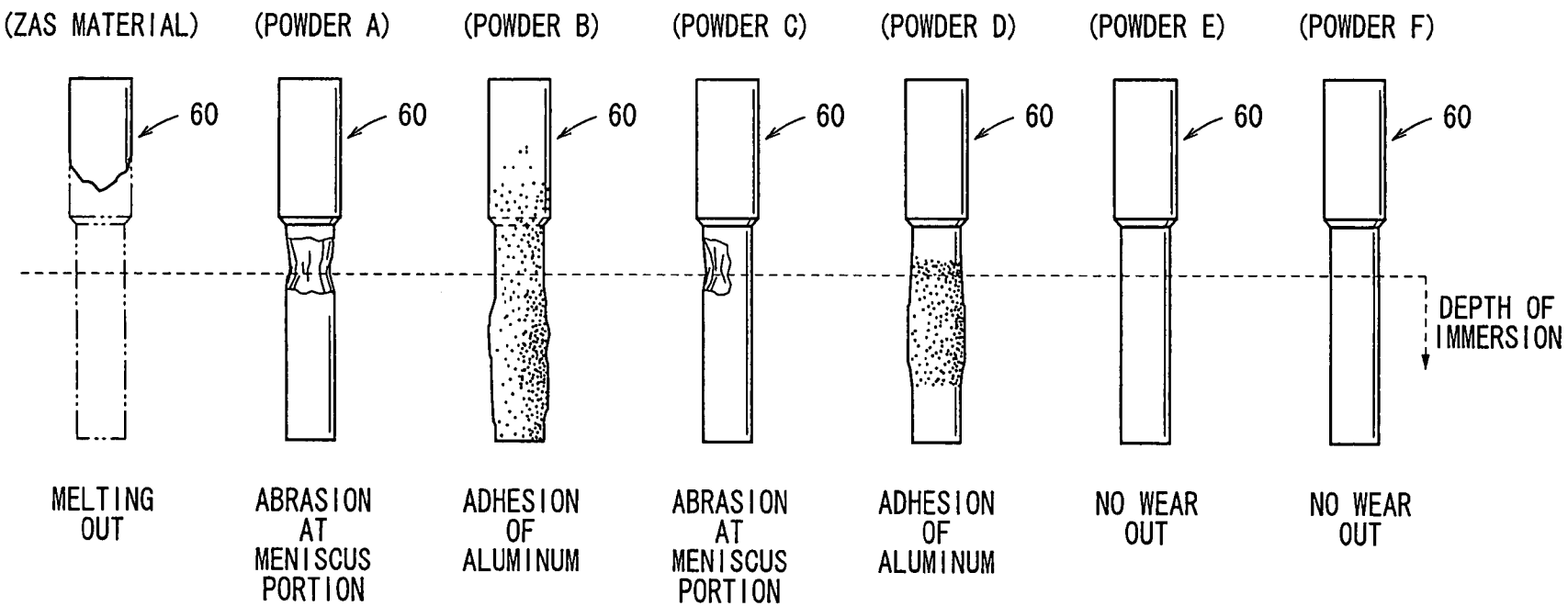
FIG. 11 illustrates a corrosion test with an aluminum molten metal for the test pieces as shown in FIG. 10.

FIG. 11 shows representative corrosion situations. In the case of the test piece 60 which was not coated with the pasty coating agent, the test piece 60 was melted to a great extent, and the original shape thereof was not maintained. On the contrary, in the case of the test pieces 60 to which Powders A to F were applied, it was confirmed that the corrosion resistance was greatly improved.

The degree of the melting out was decreased in an order of Powder A, Powder B, Powder C, Powder D, Powder E, and Powder F. Further, the degree of the melting out was decreased with respect to the immersion time, and the melting out speed was greatly decreased.

EXAMPLE 2

Figure 12:
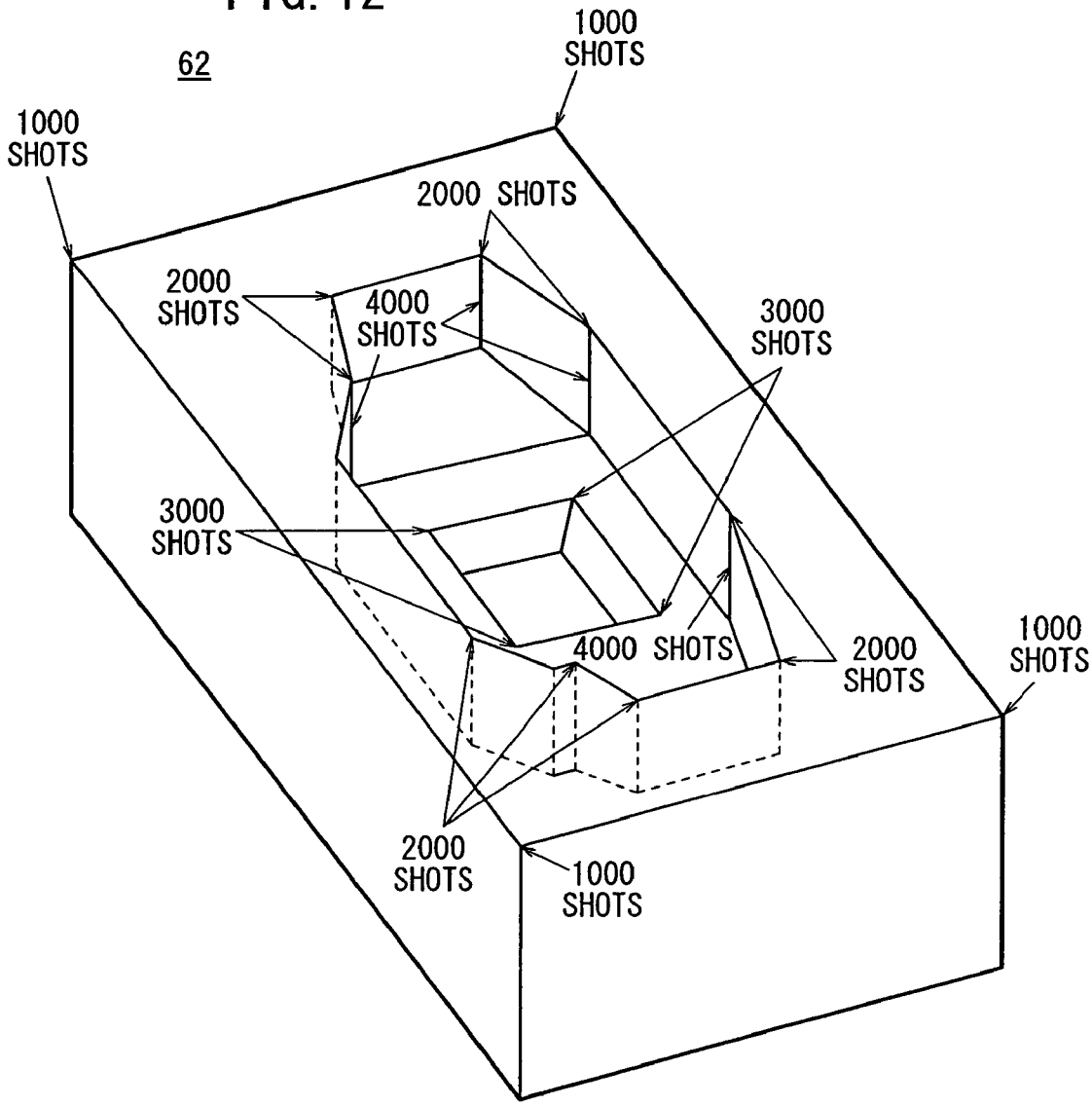
FIG. 12 illustrates, in perspective view, a die for which a durability test was carried out.

A die 62 as shown in FIG. 12 is made of Zn—Al—Sn alloy. In the case of the die 62 of this type, the cracks were observed after several thousand shots. For example, the cracks began to appear at 1000 shots at the corner portions. The cracks began to appear at 2000 to 4000 shots at the respective joining surfaces of the die. The cracks were enlarged as the number of shots was increased.

In view of the above, a surface treatment was applied to the die 62 by using Powder A described in Example 1. That is, the die 62 was coated with the pasty coating agent to provide a thickness of 1.5 mm, and then a heat treatment was applied at 500° C. for 30 minutes while allowing nitrogen gas to flow. Subsequently, the finishing processing was performed, and then the surface hardness was detected. As a result, the surface hardness was about Hv 200, and the depth of the diffusion layer was 5 mm.

The number of shots, at which the cracks began to appear in the die 62, was increased from 1000 shots to 18000 shots at the corner portions, and it was greatly increased from 2000 shots to 35000 shots, from 3000 shots to 45000 shots, and from 4000 shots to 80000 shots at the respective joining surfaces of the die respectively.

EXAMPLE 3

ZAS alloy was melted at 600° C. to prepare molten metal L. A treatment such as degassing was applied to the molten metal L, and then the molten metal was poured into a mold 50 at 550° C.

At first, in order to investigate the seeding timing, the time was set during the periods in which the material was in the state of the molten metal, the material was contained in the ladle, and the material was poured, so that the uniformity of the dispersion was observed respectively and the effect was examined (see FIG. 13). The seeding timing was defined as the period of time (second(s)) between the addition of the seeding agent SA and the contact of the molten metal L with the pouring port 52 of the mold 50.

The seeding agent SA was a powdery mixture of copper and manganese having particle sizes of 10 μm to 20 μm respectively. The amount of addition was 5% of the cast matter of the cast product 10.

Respective samples, which were cast by the casting apparatus 40, were cut in central cross sections, and a polishing treatment and a mirror-finish treatment were applied to the cross sections. After that, an alkaline corrosion treatment was applied to the surface to observe the change of the crystalline microstructure for the respective samples. The HV hardness was measured at the portion inwardly from the surface by 2 mm. Results are shown in FIG. 13.

On the other hand, when a sample was cast without seeding, then the crystals were in a form of dendrite, and the particle was in a form of tear. The long diameter was 600 μm to 800 μm, and the short diameter was 150 μm to 200 μm. The hardness was HV 110 to 120.

As clearly understood from FIG. 13, the change of the crystalline microstructure was clearly confirmed visually depending on the seeding timing. Further, the difference appeared in the crystal size and the hardness. As for the microstructural change, the layer itself was increased as the seeding timing was prolonged. However, the seeding agent SA was diffused, and there was not any contribution to the improvement in hardness and crystal size so much. On the other hand, when the seeding timing was short before starting to cast, i.e., 1 second or 5 seconds, then the seeding agent SA was not diffused sufficiently, and there was no improvement in hardness as well.

Figure 14:
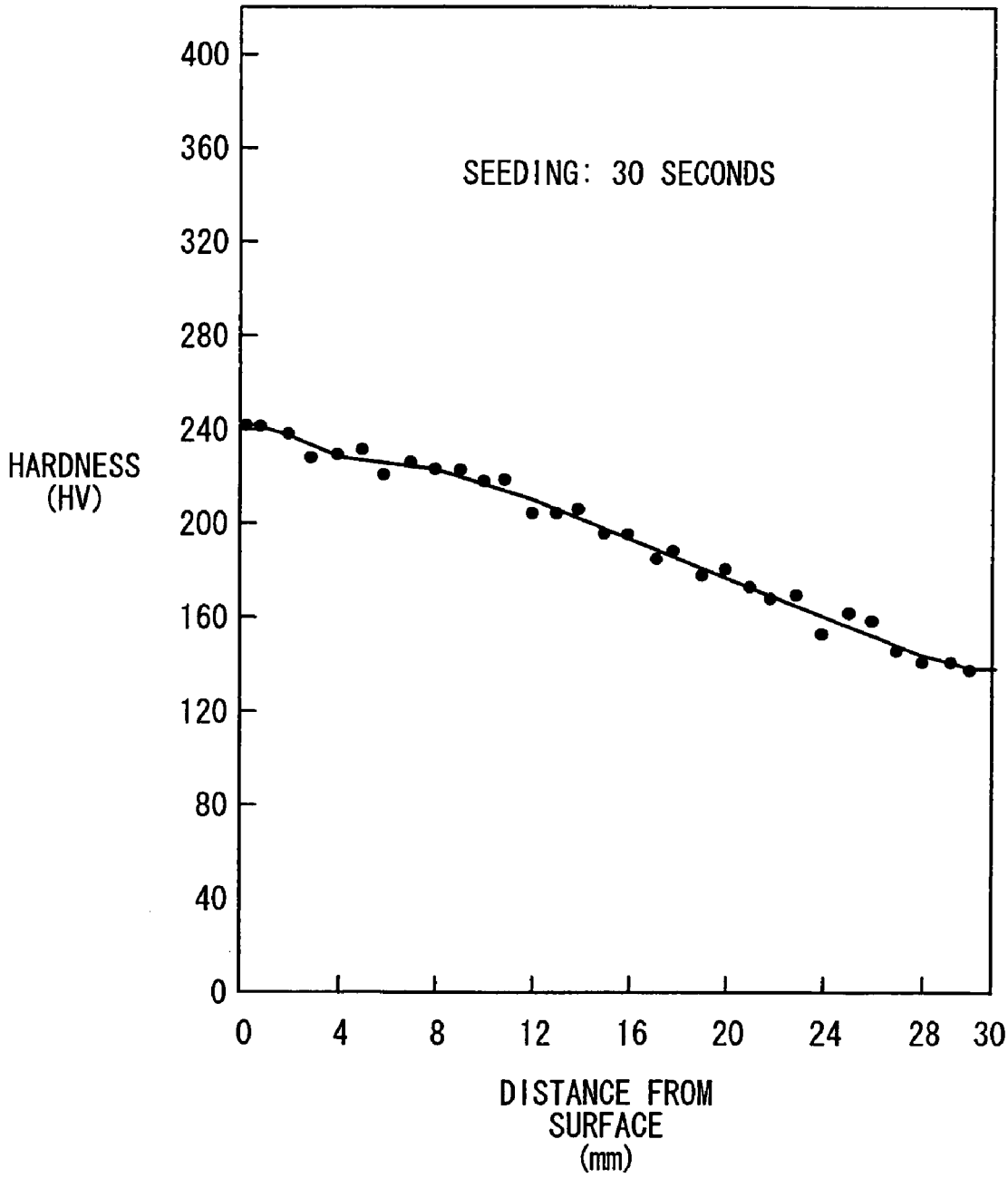
FIG. 14 illustrates the relationship between the distance from the surface and the hardness change when the seeding timing is 30 seconds.

Although copper and manganese were simultaneously seeded, the diffusion widths thereof were different from each other. Manganese was permeated inwardly by a twice or three times distance as compared with copper. Even when the seeding timing was 30 seconds, the alloy formation portion was clearly confirmed in a range about 27 to 30 mm. FIG. 14 shows the change of the hardness in this case.

According to the fact described above, the seeding timing was most preferably between 10 seconds and 30 seconds in which the fine crystal formation was improved to be 1/20 as compared with the case in which the seeding was not performed, and the hardness was improved about twice. In this experiment, the samples having the seeding timing of 10 seconds and 30 seconds were used as tensile test samples each of which was cut out based on the crystal change portion disposed in the vicinity of the surface to perform the measurement. As a result, the strengths were 480 MPa and 420 MPa which were greatly improved respectively, while the strength without seeding was 230 MPa.

EXAMPLE 4

A base material 22 made of ZAS alloy was prepared. The surface of the base material 22 was processed to form a processed surface S corresponding to a cavity. Further, the processed surface S was cleaned by removing any oil film therefrom.

After removing the oxide film from the processed surface S, the processed surface S was coated with a first paste, which contained acrylic resin, cellulose nitrate, and Cu—Mn powder (composition ratio: 5:2), so that the thickness was 1.5 mm. Further, the first paste was coated with a second paste, which was prepared by dispersing Cu—Mn—Fe—Al powder (composition ratio: 20:15:64:1) and acrylic resin in an organic solvent, so that the thickness was 2 mm.

Subsequently, the processed surface S of the base material 22, which was coated with the first and second pastes as described above, was heated for 20 minutes with a burner using propane and oxygen. Accordingly, the applied metals were diffused into the base material 22.

After that, the base material 22 was machined to manufacture a test die having a size of 300 mm×300 mm×80 mm and a maximum depth of the cavity of 30 mm. The thickness of the applied film was decreased to 0.9 mm through 1.1 mm after the heating.

In this procedure, the outmost surface of the powdery matter was oxidized by the heating with the heater. However, the thickness of the oxidized region was not more than about 0.2 mm. In the region deeper than the above, the metallic luster was observed when the oxidized layer was removed.

An etching treatment was applied for 45 seconds by using 10% NaOH. The internal microstructure was observed from the processed surface S of the base material 22. In this procedure, the thickness of the brass layer was 7 mm to 9 mm. The diffusion layer deeper than the above was changed to have a position inwardly by about 27 mm from the surface. The change was clearly observed visually because of the change of the crystals from the dendrite, for example, into the cubic crystals and the tesseral crystals.

On the other hand, in the X-ray observation, the surface of the processed surface S was in a metallic luster region in which Fe was 94% and Cu was 5%. In a region disposed inwardly from the surface by 1 mm, Cu was 50% and Zn was 50%. In a region disposed further inwardly by 5 mm, Cu was 25%, Mn was 14%, and Zn was 50%.

In a region disposed inwardly from the surface by 10 mm, Cu was 8%, Mn was 10%, and Zn was 76%. In a region disposed inwardly by 20 mm, Cu was 4%, Mn was 5%, and Zn was 82%. In a region disposed further inwardly by 30 mm, the composition of the Zn—Al—Sn alloy was observed.

For the purpose of comparison, the heat resistance test and the shock resistance test were performed by using the test die described above and a machined die with no diffusing treatment (hereinafter referred to as "comparative die"). Specifically, the cavity portion was arranged in a furnace heated to 200° C., and it was held for 10 minutes, then plunged into water having a temperature of 20° C. This procedure was repeatedly performed to observe the occurrence of any crack. As a result, in the case of the comparative die, the crack appeared at the cavity corner portion of the die at 18 cycles, and the damage was clearly observed at 28 cycles.

In contrast, in the case of the test die, no crack was observed at the corner portion even at 320 cycles, but minute cracks appeared at 374 cycles. That is, heat check resistance was remarkably improved in the test die to which the diffusing treatment was applied, as compared with the comparative die to which the diffusing treatment was not applied.

EXAMPLE 5

A surface of a base material 10 made of ZAS alloy was processed to form a processed surface S. The processed surface S was finished to have a surface roughness of 1.6 S to 3.2 S, and then a degreasing treatment was applied thereto.

A coating agent was prepared by dispersing an Mn—Cu alloy powder (Mn:Cu was 40:60) having a grain size of not more than 5 μm in an amount of 25% in a solution containing 5% nitrocellulose, 80% acetone, 10% ethanol, and 5% ethylcellosolve.

Subsequently, the entire processed surface S was coated with the coating agent so that the thickness was 1.0 mm, then left one day at room temperature to dry. After that, the processed surface S of the base material 10 was subjected to the temperature raising at a speed of 10° C./minute in a nitrogen atmosphere, and then retained at 250° C. for 30 minutes. Further, the temperature was raised over 1 hour to 340° to 350° C., and then cooled in the furnace. The cooled base material 10 was cut at the central portion, and a mirror-finish treatment was applied thereto. After that, the microstructure was observed and the hardness was measured.

The thickness of the coating agent on the processed surface S was decreased to about 0.3 mm. The metal density upon the application was 40 to 50%, and the structure was densified during the heating. However, the thickness was thinner than an assumed thickness. Therefore, it is appreciated that the metal components were permeated and diffused into the base material 10.

The surface layer ranging from the surface of the base material 10 to a position inwardly about 1.5 mm was discolored into yellow or gold, in which a brass layer was certainly formed. In the surface layer, the crystals were changed from the dendrite, for example, into the cubic crystals and the tesseral crystals. The crystal grains were decreased from the size of 1.0 mm to 1.5 mm to the size of about 30 μm to 40 μm.

A layer, which is disposed under the surface layer, was clearly different from the crystalline microstructure of the ZAS material. That is, although the dendrite was partially present, the portion for surrounding the same was changed. The portion was revealed to be Zn—Mn alloy as a result of the EPMA (Electron Probe X-ray Micro Analyzer) analysis, and the thickness was about 50 mm.

Figure 15:
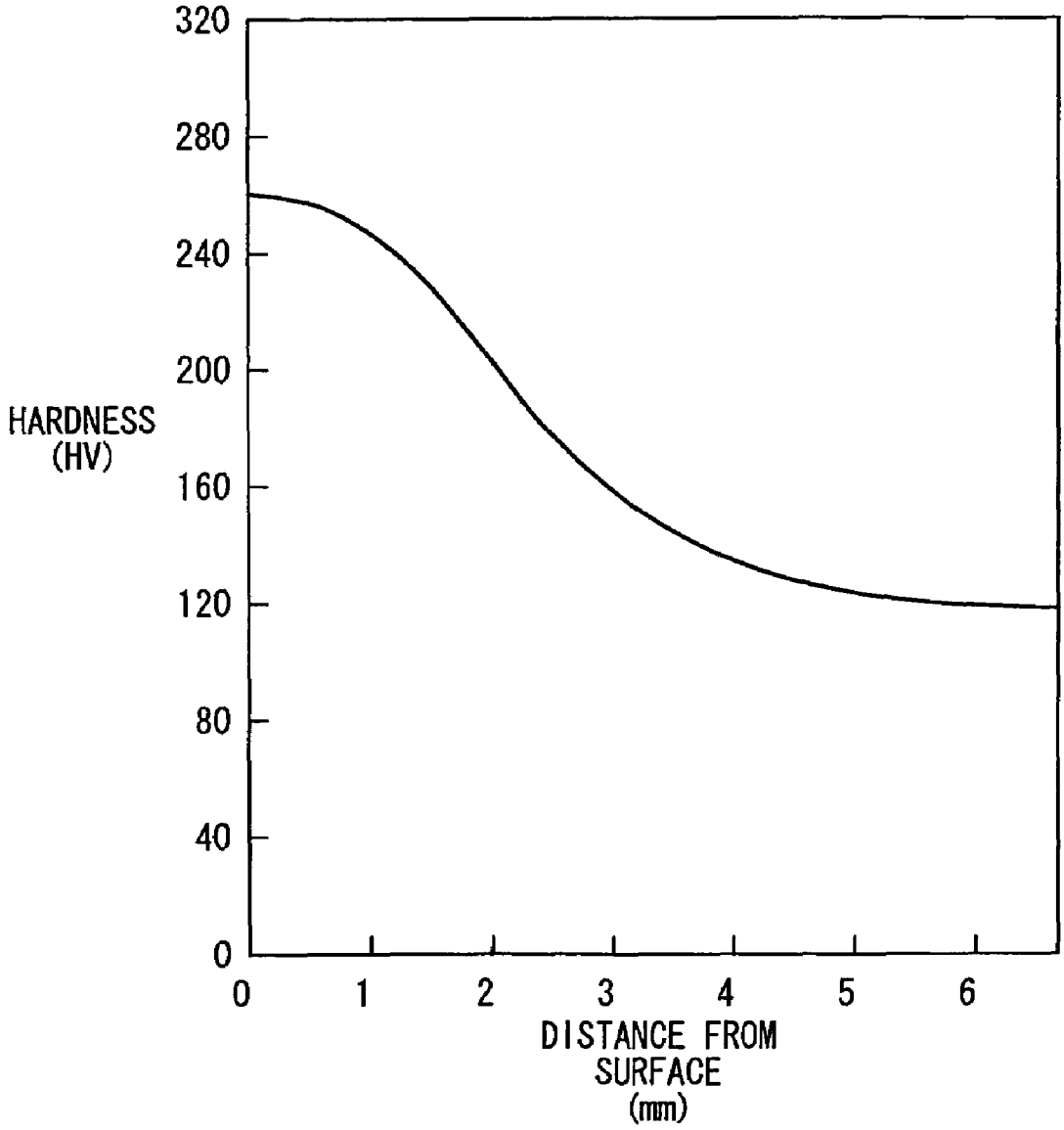
FIG. 15 illustrates a hardness distribution inwardly from a surface of a base material of which an oxide film is removed from the surface.

The hardness distribution is shown in FIG. 15. According to FIG. 15, it is clear that the hardness of the surface layer of the base material 10 was remarkably improved. Further, the boundary portion was scarcely recognized in the surface layer of the base material 10. It was confirmed that the oxide film was effectively removed and the alloy formation was advanced.

While the invention has been particularly shown and described with reference to preferred embodiments, it will be understood that variations and modifications can be effected thereto by those skilled in the art without departing from the spirit and scope of the invention as defined by the appended claims.

The invention claimed is:

1. A method of producing a metal material comprising a diffusion layer which is formed by diffusing an element into a base material of a metal and which has a depth from a surface of said base material of not less than 0.5 mm, a concentration of said element being gradually decreased from said surface to inside of said base material, said method comprising:

coating said surface of said base material with a coating agent, said coating agent consisting essentially of a powder of a substance containing said element to be diffused, a reducing agent for reducing an oxide film formed on said surface of said base material, and a solvent in which said powder of said substance and said reducing agent are dispersed or dissolved; and diffusing said element into said base material by heating said base material which is coated with said substance such that the element is diffused into the base material to a depth of not less than 0.5 mm from the surface, wherein said diffusing step causes the concentration of said element to be gradually decreased from said surface to inside of said base material such that an interface is not formed between the base metal material and the diffusion layer, and the surface of the base metal material having the element diffused therein is exposed outwardly after said diffusion step.

2. The method of producing said metal material according to claim 1, wherein said base material comprises a Zn alloy, and wherein a resin of at least one of nitrocellulose, polyvinyl alcohol, polyvinyl, acrylic, melamine, styrene, and phenol is used as said reducing agent.

3. The method of producing said metal material according to claim 2, wherein said coating agent further contains at least one metal powder of magnesium, aluminum, or manganese, or at least one alloy powder of a magnesium alloy, an aluminum alloy, and a manganese alloy.

4. The method of producing said metal material according to claim 1, wherein said base material is heated such that a temperature gradient is formed in said diffusing step.

5. The method of producing said metal material according to claim 1, wherein said diffusing step is carried out in an inert gas atmosphere.

6. The method of producing said metal material according to claim 3, wherein at least one of Ni, Sn, and Cu, is further added to said coating agent.

7. The method of producing said metal material according to claim 1, wherein the reducing agent is decomposed by the heating in said diffusing step, and a product of decomposition causes the oxide film on the surface of the base material to disappear by reduction so that the element is diffused into the base material.

8. A method of producing a metal material comprising a diffusion layer which is formed by diffusing an element into a base material of a metal and which has a depth from a surface of said base material of not less than 0.5 mm, a concentration of said element being gradually decreased from said surface to inside of said base material, said method comprising:

coating said surface of said base material with a coating agent, said coating agent including a powder of a substance containing said element to be diffused, said coating agent further including a reducing agent for reducing an oxide film formed on said surface of said base material, and said powder of said substance and said reducing agent being dispersed or dissolved in a solvent; and diffusing said element into said base material by heating said base material which is coated with said substance, wherein a Zn alloy is used as said base material, at least a part of said base material is coated with a first powder containing at least any one of copper and manganese, and then the base material having said powder with at least one of copper and manganese coated thereon is coated with a second powder containing Fe in said coating step.

* * * * *